US006317928B1

(12) United States Patent
Guillemette

(10) Patent No.: US 6,317,928 B1
(45) **Date of Patent: *Nov. 20, 2001**

(54) LOCKABLE HINGE DEVICE

(76) Inventor: Christian Guillemette, 257 Avenue St-Michel, Beauport, Québec (CA), G1C 1G4

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/332,614

(22) Filed: Jun. 14, 1999

(30) Foreign Application Priority Data

Jun. 15, 1998 (CA) ..... 2237976

(51) Int. Cl.[7] ..... E06D 11/10
(52) U.S. Cl. ..... 16/353; 16/380; 16/381
(58) Field of Search ..... 16/353, 380, 381

(56) References Cited

U.S. PATENT DOCUMENTS

| | | | | |
|---|---|---|---|---|
| 353,007 | * | 11/1886 | Schubert | 16/353 |
| 618,086 | * | 1/1899 | Haase | 16/380 |
| 737,360 | * | 8/1903 | Daly | 16/380 |
| 1,030,801 | * | 6/1912 | Berault | 16/353 |
| 3,188,686 | | 6/1965 | Orcutt | 16/169 |
| 3,621,512 | | 11/1971 | Johnson | 16/137 |
| 3,733,649 | | 5/1973 | Nagy et al. | 16/137 |
| 3,969,788 | | 7/1976 | McCullough | 16/144 |
| 4,116,514 | | 9/1978 | Lawrence | 339/4 |
| 4,135,273 | | 1/1979 | Holmes | 16/169 |
| 4,385,418 | | 5/1983 | Loftis et al. | 16/381 |
| 4,864,692 | | 9/1989 | Prevot et al. | 16/381 |
| 5,337,453 | | 8/1994 | Bargesser | 16/380 |
| 5,666,695 | | 9/1997 | Jergers et al. | 16/381 |
| 5,711,053 | | 1/1998 | Hafner | 16/380 |

* cited by examiner

*Primary Examiner*—Anthony Knight
*Assistant Examiner*—Enoch E. Peavey
(74) *Attorney, Agent, or Firm*—St. Onge Steward Johnston & Reens LLC

(57) ABSTRACT

A lockable hinge device of the type having a female flap and a male flap for attachment to structures to be hinged together and having interfittable knuckles defining together a passageway. A hinge pin is insertable into the passageway to pivotally connect the female flap to the male flap. The female flap has an outermost knuckle with a longitudinal slot extending through the entire length thereof. That slot is associated with a cut provided on the edge of the male knuckle adjoining the outermost female knuckle. The flaps are thus pivotable between an unlock position where the cut is in an aligned relationship with the slot and a lock position where the cut is in an unaligned relationship with the slot. On its side, the hinge pin has along its length a tooth projecting therefrom. The tooth is sized to freely slide in the slot and to fit entirely in the cut thereby allowing the hinge pin to be inserted in the passageway while the flaps are pivoted in the unlock position with the slot guiding the tooth up to said cut to sit therein, and then as the flaps are pivoted in the lock position, the tooth sitting in the cut is caused to slide under the inner edge of the female outermost knuckle thereby locking the hinge pin in the passageway.

6 Claims, 3 Drawing Sheets

LOCKABLE HINGE DEVICE

FIELD OF THE INVENTION

The present invention generally relates to hinges for door or window, more particularly it relates to a lockable hinge device of the type comprising two hinge flaps pivotally connected together by means of a hinge pin.

BACKGROUND OF THE INVENTION

A typical hinge device for door and window comprises a female flap and a male flap with interfitted knuckles pivotally connected to each other by means of a hinge pin. A drawback with such a prior art hinge device is that once it is assembled and operatively installed on a door or on a window assembly, it is very easy for an intruder to dismantle such a hinge and to remove the door or window by simply pushing the hinge pin out of the knuckles. The hinge pin of such prior art hinge device also has a tendency to slightly come out of the knuckles by itself under the effect of the pivoting movement of the flaps.

Many attempts have been made in prior art to develop a security hinge that would overcome those drawbacks. However none of those prior attempts had proven to give a satisfactory solution. Hence, the security hinges developed in prior art are generally either complex and expensive to manufacture and/or inadequate, ineffective. Examples of such prior art attempts are given by example in U.S. Pat. Nos. 3,188,686; 3,621,512; 3,733,649; 3,969,788; 4,116,514; 4,135,273; 4,385,418; 4,864,692; 5,337,453; 5,666,695; and 5,711,053.

Thus, there is still a need for an adequate lockable security hinge that will be inexpensive to manufacture and thus cost-effective.

SUMMARY OF THE INVENTION

An object of the present invention is therefore to propose a lockable hinge device that will satisfy these above-mentioned needs. A main object of the present invention is to propose a lockable hinge device providing an unlock position when its flaps are at 0° so as to allow the easy insertion of a hinge pin onto said hinge during the mass manufacturing of door assemblies.

It is also an object of the present invention to propose a lockable hinge device that will be difficult and even impossible to remove once installed on the structures to be hinged together according to one aspect of the invention. This device will thus prevent burglars and intruders to easily remove the hinges of a door or a window.

According to the present invention, these objects are achieved with a lockable hinge device of the type having:

- a female flap and a male flap for attachment to structures to be hinged together and having interfittable knuckles defining together a passageway; and
- a hinge pin insertable into the passageway to pivotally connect the female flap to the male flap.

The hinge device is characterized in that the female flap has a first outermost knuckle and a second outermost knuckle. At least one of these first and second outermost knuckles has a longitudinal slot extending through the entire length thereof. The male flap has a knuckle with an outer edge adjoining an inner edge of the at least one of the first and second outermost knuckles of the female flap. That outer edge has a cut thereon. The flaps are thus pivotable between an unlock position where the cut is in an aligned relationship with the slot and a lock position where the cut is in an unaligned relationship with the slot.

The hinge is further characterized in that the hinge pin has along its length a tooth projecting therefrom. That tooth is sized to freely slide in the slot and to fit entirely in the cut, thereby allowing the hinge pin to be inserted in the passageway while the flaps are pivoted in the unlock position with the slot guiding the tooth up to the cut to sit therein, and then as the flaps are pivoted in the lock position, the tooth sitting in the cut is caused to slide under the inner edge of the at least one of the first and second outermost knuckles of the female flap, thereby locking the hinge pin in the passageway.

In a first preferred embodiment, the slot and the cut are located respectively on the at least one of the first and second outermost knuckles of the female flap and on the outer edge of the male flap so that the flaps are at more than 0° angle, and preferably at less than 180°, to each other in the unlock position. More preferably, the flaps are in the unlock position while the female flap is at right angles with the male flap.

In another preferred embodiment, the slot and the cut are located respectively on the at least one of the first and second outermost knuckles of the female flap and on the outer edge of the male flap so that the flaps are at 0° angle to each other in the unlock position. Also preferably, both of the first and second outermost knuckles of the female flap have such a longitudinal slot extending through the entire length thereof, whereby, in use, either one of the first and second outermost knuckles may be set on top.

As can be appreciated, a lockable hinge device according to the present invention provides a simple and inexpensive mechanism to prevent anyone to easily remove hinges of a door, for example, and open the same.

DESCRIPTION OF PREFERRED EMBODIMENTS

Figure 1:
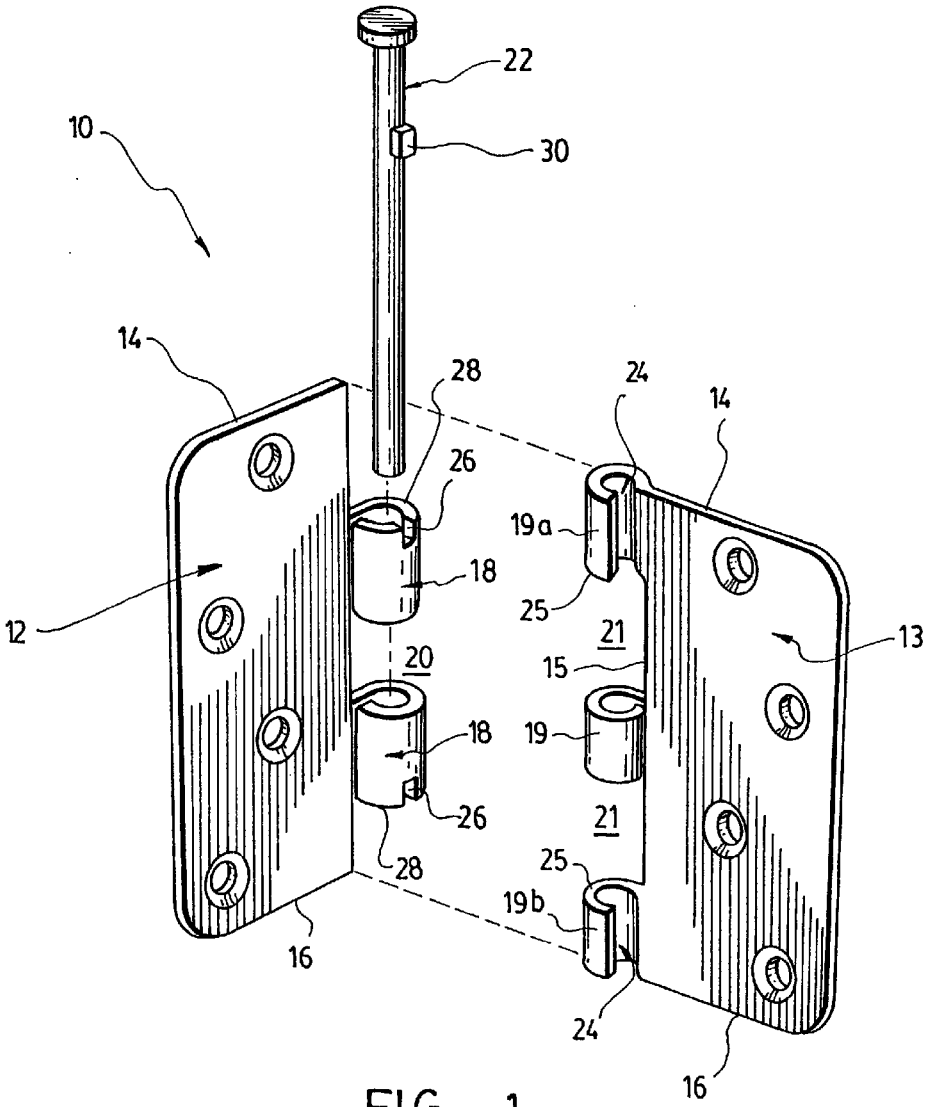
FIG. 1 is an exploded perspective view of a lockable hinge device according to a first preferred embodiment of the present invention.
Figure 2:
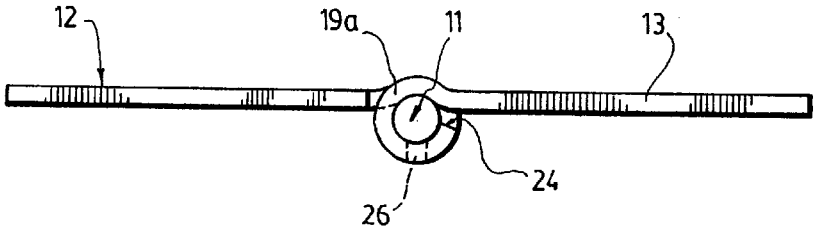
FIG. 2 is a top view of the hinge device of FIG. 1
Figure 3:
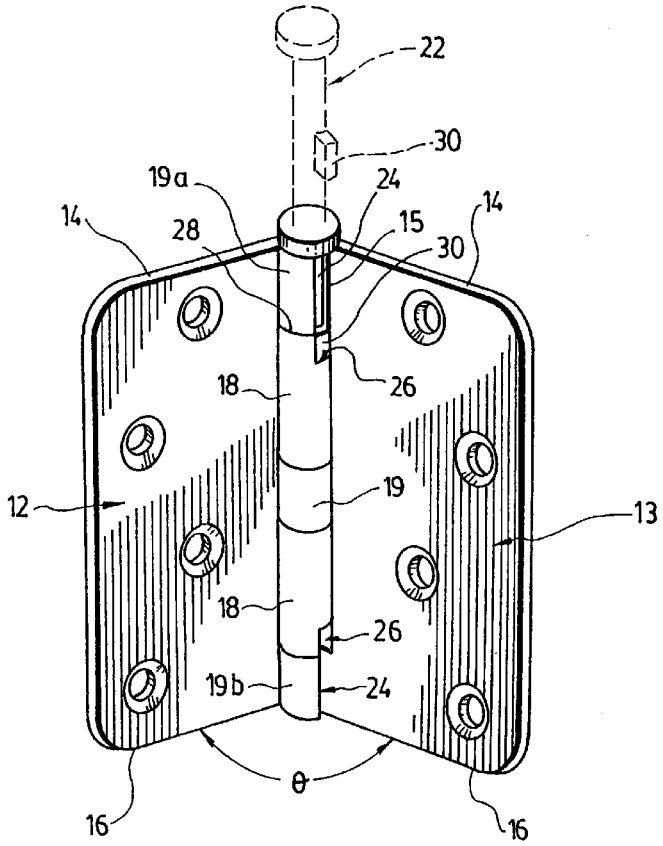
FIG. 3 is a perspective view of the lockable hinge device of FIG. 1 showing the flaps in a first unlock position, thereby allowing the hinge pin to be inserted into the knuckles.
Figure 4:
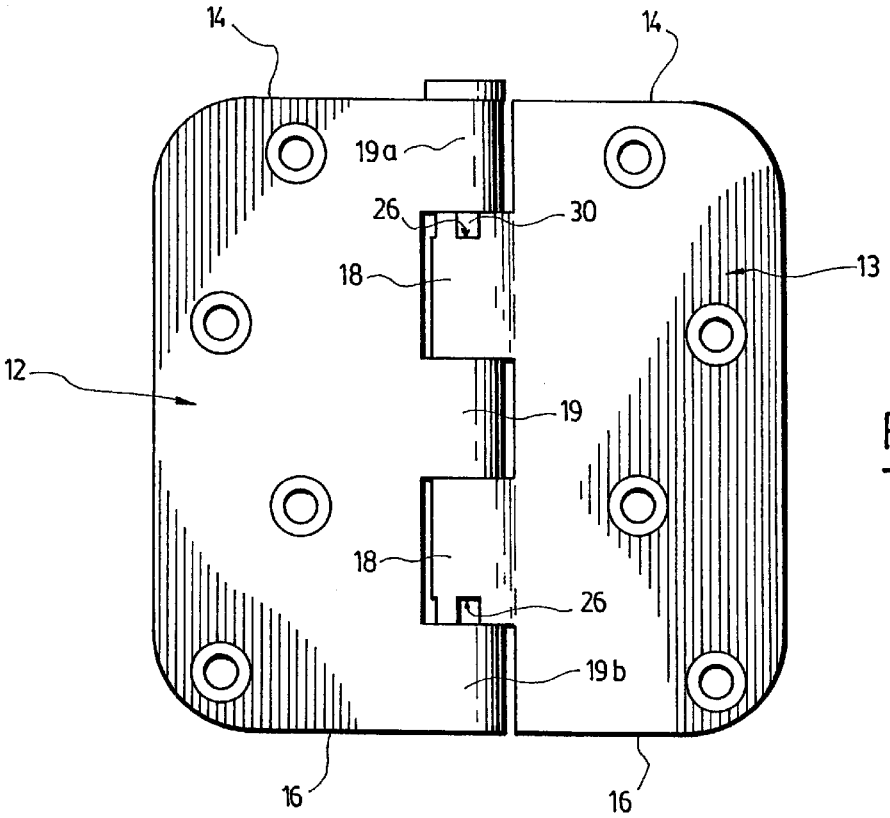
FIG. 4 is a side elevational view of the hinge device of FIG. 1 showing the flaps in a lock position.
Figure 5:
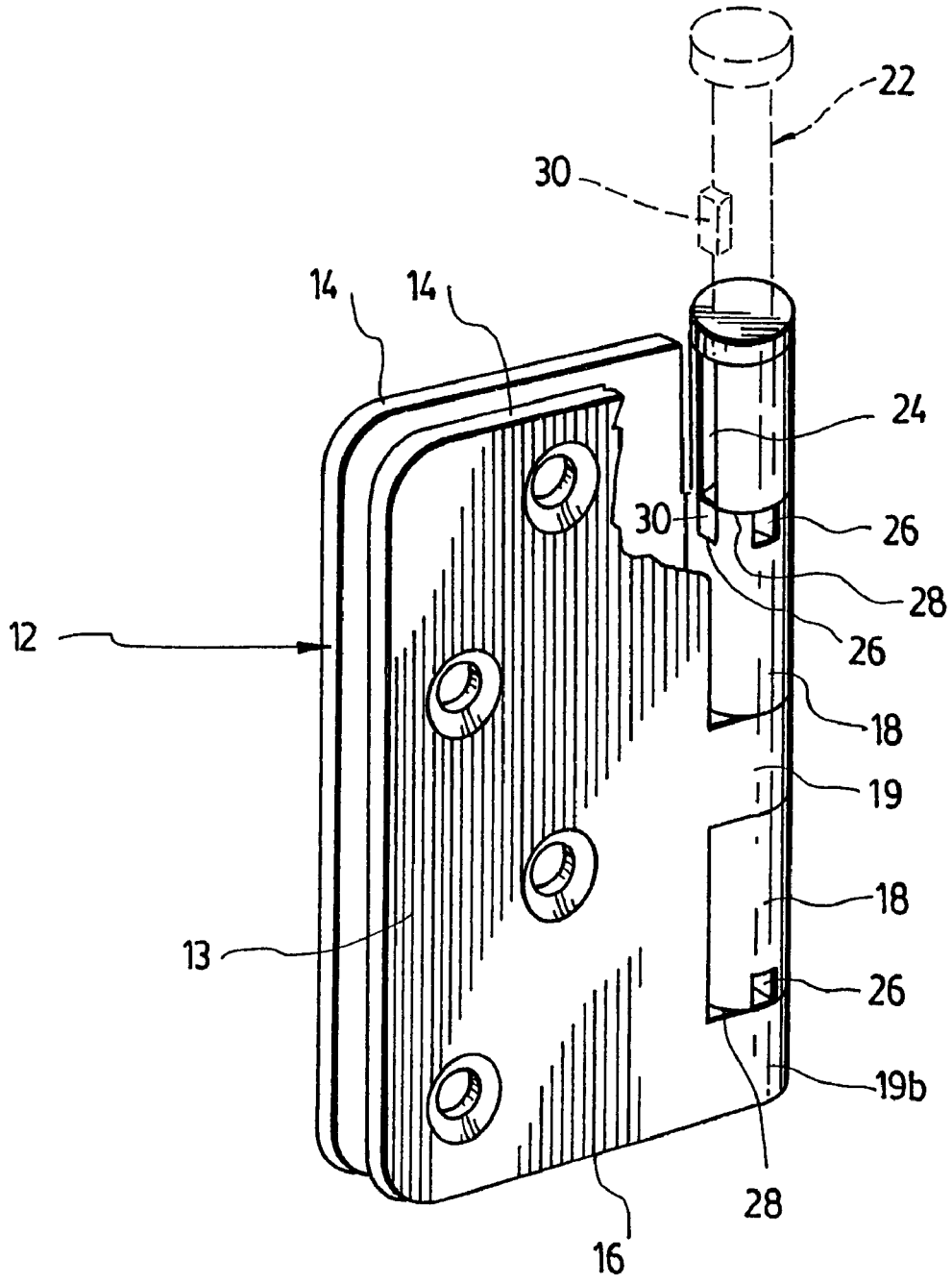
FIG. 5 is a perspective view of a second preferred embodiment of a lockable hinge device according to the present invention showing the flaps in a second unlock position, thereby allowing the hinge pin to be inserted into the knuckles.

Referring to FIG. 1, a lockable hinge device (10) according to the present invention comprises a male flap (12) and a female flap (13) for attachment to structures, such as a door and a door frame, to be hinged together. The male flap (12) and the female flap (13) have interfittable knuckles (18,19) defining together a passageway (11), as best seen in FIG. 2, in which a hinge pin (22) is slidably insertable to pivotally connect the flaps (12,13), as shown in FIGS. 3 to 5. The knuckles (18,19) have the shape of tubes adjoining with adjacent gaps (20,21) in registry. In the preferred embodiments illustrated, the female flap (13) has three knuckles (19, 19*a* and 19*b*) and the male flap (12) has two knuckles (18). However, the flaps of another embodiment of the present invention may have a different number of knuckles. The knuckles (18) of the male flap (12) are adapted to be interfitted with the knuckles (19) of the female flap (13), that is to say that each knuckle (18) of the male flap (12) is to be inserted between and axially aligned with two knuckles (19) of the female flap (13). Each flap (12,13) once installed has an upper side (14) and a lower side (16) and each of the knuckles (19) of the female flap (13) located closest to the upper side (14) and to the lower side (16) thereof is called respectively the first outermost knuckle (19*a*) and the second outermost knuckle (19*b*) as opposed to the inner knuckle(s) (19) disposed between those outermost knuckles (19*a*, 19*b*).

As conventional hinge device of the type and as shown in FIGS. 3 and 5, the hinge pin (22) is devised to be first inserted and slid into one of the outermost knuckle (19*a* or 19*b*) of the female flap (13) then through an adjoining knuckle (18) of the male flap (12) and then through the remaining knuckles (18,19).

The hinge device (10) is characterized in that at least one of the first and second outermost knuckles (19*a*,19*b*) of the female flap (13) has a longitudinal slot (24) extending through the entire length thereof. In the preferred embodiments illustrated, both the outermost knuckles (19*a*,19*b*) comprise such a longitudinal slot (24) which makes the hinge reversible as either one of the first and the second outermost knuckles (19*a*,19*b*) may be installed upwards. In that way, the hinge device (10) can be used and locked in both sides. However, a hinge device with only one longitudinal slot would not depart from the scope of the present invention.

For strength or solidity considerations combines with manufacturing considerations, each slot (24) extends along a longitudinal side (15) of the female flap (13).

Referring more particularly to FIGS. 1, 3 or 5, it can be appreciated that the longitudinal slot (24) is devised to be associated with a cut (26) provided on the outer edge (28) of the adjoining knuckle (18) of the male flap (12). In the preferred embodiments illustrated, the outer edge (28) of both the knuckles (18) of the male flap (12) adjoining an inner edge (25) of a corresponding outermost knuckle (19*a*, 19*b*) of the female flap (13) has such a cut (26) thereon. The flaps (12,13) are thus pivotable between an unlock position, as shown in FIG. 3, where each cut (26) is in an aligned relationship with a corresponding slot (24), and a lock position, as in FIG. 4, where each cut (26) is in an unaligned relationship with a corresponding slot (24).

The hinge device (10) is further characterized in that the hinge pin (22) has along its length a tooth-like protuberance (30) projecting therefrom. That tooth (30) is sized to freely slide in the longitudinal slot (24) and to fit entirely in the cut (26), as shown in FIG. 3 or 5, thereby allowing the hinge pin (22) to be inserted in the passageway (11) while the flaps (12,13) are pivoted in the unlock position with the slot (24) guiding the tooth (30) up to the cut (26) to sit therein. Then, as the flaps (12,13) are pivoted in a lock position, as in FIG. 2 or 4, the tooth (30) sitting in the cut (26) is carried along under the inner edge (25) of the corresponding outermost knuckle (19*a*,19*b*) of the female flap (13), thereby locking the hinge pin (22) in the passageway (11) and preventing any intruder from removing the pin (22) to dismantle the hinge device (10). The tooth (28) is preferably made integral with the main part of the hinge pin. It can be shaped by press moulding.

In conventional door assembly, the flaps (12,13) are at an angle θ of 0° to each other as the door is closed. Therefore, in the first preferred embodiment, as shown in FIG. 3, the slot (24) and the cut (26) are located so that the angle θ between the flaps (12,13) is more than 0° angle, and preferably less than 180°, in the unlock position, thereby preventing any intruder to dismantle the hinge as the door is closed.

In the first preferred embodiment illustrated in FIGS. 1 to 4, and only for manufacturing considerations, the flaps (12,13) are at substantially 90° angle to each other in the unlock position.

Referring to FIG. 5, a second preferred embodiment of the present invention is illustrated. That embodiment is particularly suitable for pre-assembled door assembly having a door opening from the inside as most interior doors do. Such doors do not need to be intruders or burglars proof. However, as mentioned before, it is not uncommon to see a hinge pin (22) coming out of the knuckles (18,19) by itself under the effect of the pivoting movement of the flaps (12,13). Thus, a hinge device (10) according to the present invention is also advantageous for such interior doors or windows. In that case, the specific angle between the flaps (12,13) in the unlock position does not really matter for a functional point of view. However, for a manufacturing point of view, it may be very advantageous to locate the slot (24) and the cut (26) so that the flaps are at 0° angle to each other in the unlock position. Indeed, in conventional mass manufacturing of door assemblies, the flaps (12,13) are usually independently installed on their respective structure prior to inserting the hinge pin (22) which is normally inserted while the door and the frame are in a closed relationship. Therefore, in that case, the flaps (12,13) as shown in FIG. 5 should be in an unlock position when the angle θ is 0°. Also as shown in FIG. 5, the outer edge of the male flap (13) may have an additional cut (26) located thereon such that the flaps (12,13) may have an additional unlock position.

Although the present invention has been explained hereinabove by way of preferred embodiments thereof, it should be understood that the invention is not limited to these precise embodiments and that various changes and modifications may be effected therein without departing from the scope or spirit of the invention.

What is claimed is:

1. A lockable hinge device attached to a door assembly during a mass production manufacturing process comprising:

a female flap and a male flap for attachment to structures to be hinged together and having interfittable knuckles defining together a passageway; and a hinge pin insertable into the passageway to pivotally connect the female flap to the male flap; and wherein, the female flap has a first outermost knuckle and a second outermost knuckle, at least one of said first and second outermost knuckles having a longitudinal slot extending through the entire length thereof and the male flap has a knuckle with an outer edge adjoining an inner edge of said at least one of said first and second outermost knuckles of the female flap, said outer edge having first and second cuts spaced angularly apart and located on said outer edge, said flaps being pivotable between a manufacturing position where said first cut is in an aligned relationship aligned with the slot, an unlock position where said second cut is in an aligned relationship with said slot, and a lock position where said first and second cuts are in an unaligned relationship with the slot; and wherein the hinge pin has along its length a tooth projecting therefrom, said tooth being sized to freely slide in said slot and to fit entirely in each of said cuts, thereby allowing the hinge pin to be displaced in the passageway while the flaps are pivoted in the manufacturing and unlock positions with the slot guiding the tooth up to each of said cuts to sit therein, and then as the flaps are pivoted in the lock position, the tooth sitting in either of said cuts is caused to slide under the inner edge of said at least one of said first and second outermost knuckles of the female flap, thereby locking the hinge pin in the passageway;

the lockable hinge device being characterized in that said slot and said cuts are located respectively on said at least one of said first and second outermost knuckles of the female flap and on said outer edge of the male flap such that the hinge pin is inserted in the manufacturing position where flaps are at 0° angle to each other in the manufacturing position.

2. A lockable hinge device as claimed in claim 1 wherein said slot and said additional cut are located respectively on said at least one of said first and second outermost knuckles of the female flap and on said outer edge of the male flap such that the flaps are at more than 0° angle and less than 180° angle to each other in the additional unlock position.

3. A lockable hinge device as claimed in claim 1, wherein said slot and said additional cut are located respectively on said at least one of said first and second outermost knuckles of the female flap and on said outer edge of the male flap such that the flaps are at substantially 90° angle to each other in the additional unlock position.

4. A lockable hinge device as claimed in claim 1, wherein the outer edge of the male flap has an additional cut located thereon such that the flaps are at more than 0° angle to each other in an additional unlock position.

5. A lockable hinge device as claimed in claim 1, wherein both of said first and second outermost knuckles of the female flap have a longitudinal slot extending through the entire length thereof, whereby, in use, either one of said first and second outermost knuckles may be set on top.

6. A lockable hinge device as claimed in claim 1, wherein said slot extends along a longitudinal side of the female flap.

* * * * *